US008383563B2

(12) United States Patent
Poirier et al.

(10) Patent No.: US 8,383,563 B2
(45) Date of Patent: Feb. 26, 2013

(54) METHOD FOR ENHANCING THE OXIDATION AND NITRATION RESISTANCE OF NATURAL GAS ENGINE OIL COMPOSITIONS AND SUCH COMPOSITIONS

(75) Inventors: Marc-André Poirier, Sarnia (CA); Kathleen Hoard Tellier, Cherry Hill, NJ (US); Stanley James Cartwright, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 468 days.

(21) Appl. No.: 12/221,638

(22) Filed: Aug. 5, 2008

(65) Prior Publication Data

US 2009/0042753 A1 Feb. 12, 2009

Related U.S. Application Data

(60) Provisional application No. 60/964,243, filed on Aug. 10, 2007.

(51) Int. Cl.
*C10M 171/00* (2006.01)
*C10M 169/04* (2006.01)

(52) U.S. Cl. ..... 508/526; 508/563; 508/525; 508/531; 508/583

(58) Field of Classification Search ..... 508/382, 508/563, 531, 525, 526, 583
See application file for complete search history.

(56) References Cited

U.S. PATENT DOCUMENTS

| | | | | |
|---|---|---|---|---|
| 3,912,640 | A * | 10/1975 | Anzenberger, Sr. | 508/254 |
| 5,688,748 | A | 11/1997 | Tomizawa | |
| 5,726,133 | A | 3/1998 | Blahey et al. | |
| 6,010,987 | A | 1/2000 | Stiefel et al. | |
| 6,080,301 | A | 6/2000 | Berlowitz et al. | |
| 6,140,281 | A | 10/2000 | Blahey et al. | |
| 6,140,282 | A | 10/2000 | Cartwright et al. | |
| 6,143,701 | A | 11/2000 | Boffa | |
| 6,153,564 | A | 11/2000 | Arunasalam et al. | |
| 6,180,575 | B1 * | 1/2001 | Nipe | 508/227 |
| 6,191,081 | B1 | 2/2001 | Cartwright et al. | |
| 6,232,276 | B1 | 5/2001 | Stiefel et al. | |
| 6,642,191 | B2 | 11/2003 | Palazzotto et al. | |
| 6,730,638 | B2 | 5/2004 | Farng et al. | |
| 6,734,150 | B2 * | 5/2004 | Gao et al. | 508/364 |
| 6,756,348 | B2 | 6/2004 | Palazzotto et al. | |
| 2002/0142923 | A1 * | 10/2002 | Gatto | 508/378 |
| 2003/0148900 | A1 * | 8/2003 | Palazzotto et al. | 508/501 |
| 2003/0166473 | A1 * | 9/2003 | Deckman et al. | 508/192 |
| 2003/0176296 | A1 * | 9/2003 | Deckman et al. | 508/192 |
| 2004/0014615 | A1 | 1/2004 | Gao et al. | |
| 2004/0142827 | A1 * | 7/2004 | Palazzotto et al. | 508/502 |
| 2004/0192563 | A1 | 9/2004 | Vann et al. | |
| 2004/0198615 | A1 | 10/2004 | Friend et al. | |
| 2004/0248744 | A1 | 12/2004 | King et al. | |
| 2005/0153851 | A1 | 7/2005 | Cartwright | |
| 2005/0209110 | A1 | 9/2005 | Roski et al. | |
| 2005/0288194 | A1 | 12/2005 | Small et al. | |
| 2006/0014653 | A1 * | 1/2006 | Busse et al. | 508/391 |
| 2007/0111904 | A1 * | 5/2007 | Van Dam | 508/273 |
| 2007/0117724 | A1 * | 5/2007 | Cartwright | 508/460 |

FOREIGN PATENT DOCUMENTS

| | | | |
|---|---|---|---|
| DE | 15 94 405 | A1 | 5/1970 |
| EP | 0 860 495 | A2 | 8/1998 |
| EP | 1 265 976 | B1 | 11/2004 |
| WO | WO 01/60957 | A | 8/2001 |

OTHER PUBLICATIONS

Akihiko Yano, Shintaro Watanabe and Yasunori Miyazaki, "Study on Sludge Formation during the Oxidation Process of Turbine Oils", *Tribology Transactions*, 47, 111-122, 2004.

* cited by examiner

*Primary Examiner* — Pamela H Weiss
(74) *Attorney, Agent, or Firm* — Robert A. Migliorini

(57) ABSTRACT

The resistance to oxidation and nitration of a gas engine oil is improved by the use of a combination of a hindered phenolic antioxidant and an (alkylated) phenyl-α-naphthylamine antioxidant. The additional use of an organo molybdenum compound further enhances the resistance to oxidation and nitration.

8 Claims, No Drawings

METHOD FOR ENHANCING THE OXIDATION AND NITRATION RESISTANCE OF NATURAL GAS ENGINE OIL COMPOSITIONS AND SUCH COMPOSITIONS

CROSS-REFERENCE TO RELATED APPLICATIONS

This is a Non-Provisional Application that claims priority to U.S. Provisional Application 60/964,243 filed Aug. 10, 2007, which is herein incorporated by reference.

BACKGROUND OF THE INVENTION

1. Field of the Invention

The present invention relates to lubricating oils for the lubrication of gas fired engines and to the use of anti-oxidants to provide such oils with resistance to oxidation and nitration.

2. Related Art

Gas fired engines are typically 4-cycle engines having up to 16 cylinders similar to heavy duty diesel engines. The engines are used in the Oil and Gas industry to compress natural gas at the well heads and along pipelines as well as to generate local power. Due to the nature of this application, the engines fueled by natural gas often run continuously near full load conditions, shutting down only for maintenance or oil changes. Because the lubricant is subjected to a constant high temperature environment, the life of the lubricant is often limited by its oxidation stability. Moreover, because natural gas fired engines run with high emissions of nitrogen oxides ($NO_x$), the lubricant life may also be limited by its nitration resistance. A longer term requirement is that the lubricant must also maintain cleanliness within the high temperature environment of the engine, especially for critical components such as the piston and the piston rings. Therefore, it is desirable for gas engine oils to have good cleanliness qualities while promoting long life through enhanced resistance to oxidation and nitration.

U.S. Pat. No. 6,642,191 is directed to a lubricating oil containing a particular phenolic antioxidant useful for natural gas fueled engines. The patent recites that the lubricating oil employs as base oil a Group II, Group III or Group IV base oil in combination with one or more of a hindered phenol of the general formula

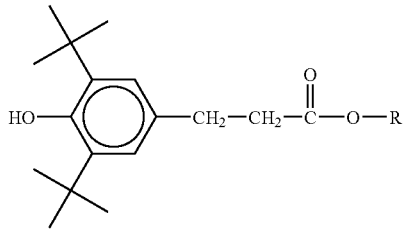

wherein R is a $C_7$ to $C_9$ alkyl group. The lubricating oil can also contain dispersants, wear inhibitors and detergents. The Group II, III and IV base oils are recited as including base oils that may be derived from natural lubricating oils, synthetic lubricating oils and mixtures thereof, and include base oils is obtained by the isomerization of synthetic waxes and slack waxes, and PAO. Despite the fact that the patent teaches away from the use of excess quantities of the recited hindered phenol as well as away from the use of additional types of other hindered phenols or other antioxidants as their presence may reduce the synergistic effect obtained when the recited hindered phenol is used with a Group II, III or IV base oil, the patent recites that additional antioxidants may be present including a lengthy list of other hindered phenols and diphenyl amine type antioxidants including alkylated diphenylamine, phenyl alpha naphthylamine and alkylated alpha-naphthylamine.

U.S. Pat. No. 6,756,348 is directed to lubricating oils having enhanced resistance to oxidation, nitration and viscosity increase. The lubricating oil utilizes an antioxidant system comprising sulfurized isobutylene in combination with one or more of a hindered phenol. The hindered phenol can be butylated hydroxyl toluene, 3,5-di-t-butyl-4-hydroxy phenol propionate $C_7$-$C_9$ alkyl ester and mixtures thereof. Additional antioxidants can be present including other phenolic type anti oxidants as well as diphenylamine type antioxidants including alkylated diphenylamine, phenyl alpha-naphthyl amine and alkylated alpha naphthyl amine. In addition, organo molybdenum compounds such as sulfurized oxymolybdenum di-thiocarbamate may also be present. The base stocks include Group I, II, III, IV and V type base oils and include natural and synthetic stocks including PAO, isomerate of synthetic waxes or slack waxes. In the Examples only Group I or Group II base oils were employed.

U.S. 2004/0198615 is directed to a lubricating oil composition containing a Mannich product obtained by the reaction of an aldehyde, an amine and a di-secondary alkyl hindered phenol, and at least one additional additive selected from the group consisting of hydrocarbyl diphenylamines, sterically hindered phenols, metal hydrocarbyl dithiophosphates, molybdenum dithiocarbamates, sulfurized olefins and mixtures thereof. The oil of lubricating viscosity includes any natural or synthetic oil or mixtures thereof. Synthetic oils include polymerized or interpolymerized olefins, PAO, liquid esters, liquid esters of phosphorus containing acids, synthetic oils produced from Fischer-Tropsch reactions and hydroisomerized Fischer-Tropsch hydrocarbons and waxes. Antioxidants are recited as generally including hydrocarbyl diphenylamines, and sterically hindered phenols.

EP 1,265,976 is directed to a method for controlling soot induced viscosity increase in diesel engine lubricating oils by using a combination of additives which are an oil soluble trinuclear organo molybdenum compound and at least one other compound selected from a phenolic antioxidant and an aminic antioxidant. The base oils for the diesel engine lubricating oil include natural or synthetic lubricating oils having a kinematic viscosity at 100° C. of 3.5 to 25 $mm^2/s$. The phenolic antioxidants are preferably hindered phenolic antioxidants and exemplified by a long list of the typical hindered phenolic antioxidants. Aminic antioxidants are described as diarylamines, aryl naphthylamines, alkyl derivatives of the diarylamines and of the aryl naphthylamines, including butyl phenyl α-naphthylamine, pentyl phenyl-α-naphthylamine, hexyl phenyl-α-naphthylamine, heptyl phenyl-α-naphthylamine.

U.S. Pat. No. 6,730,638 is to a lubricating oil formulation containing a lubricating oil base stock, a boron containing ashless dispersant, a molybdenum containing friction reducing agent, a metal type detergent and zinc dithiophosphate. Also present can be phenolic and aminic antioxidants and mixtures thereof. Table 1 describes formulations containing mixtures of phenolic and aminic antioxidants but does not identify the particular ones employed.

U.S. Pat. No. 6,153,564 is directed to lubricating oil compositions comprising a base stock having a kinematic viscosity at 100° C. of from 2 to 20 $mm^2/s$, an oil soluble trinuclear organo-molybdenum compound and other additives which include antioxidants. Suitable antioxidants include copper-containing antioxidants, sulfur-containing antioxidants, aromatic amine-containing antioxidants and phenolic antioxidants. Numerous examples of each type are given. Among the many aminic-type antioxidants recited are naphthyl amines, diphenylamines including alkyl substituted diphenylamines.

U.S. Pat. No. 6,734,150 is directed to a lubricating oil composition comprising a base stock and an antioxidant comprising an oil soluble trinuclear organomolybdenum compound and at least one other compound selected from a phenolic antioxidant and an aminic antioxidant. The base oil has a kinematic viscosity at 100° C. of 2 to 20 $mm^2/s$ and includes Group II and Group III base stocks which may be a natural or synthetic lubricating oil. Phenolic antioxidants are preferably hindered phenolic antioxidants and are exemplified by a lengthy list while aminic antioxidants are generally identified as diarylamines, aryl naphthylamines and alkyl derivatives of the diarylamines and of the aryl naphthylamines. Preferred antioxidants are represented by the formula

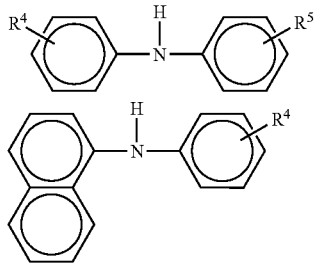

wherein each of $R^4$ and $R^5$ is hydrogen or the same or different $C_1$-$C_8$ alkyl group. Included in a lengthy list of amines are recited various alkyl phenyl-α-naphthylamines.

See also U.S. Pat. Nos. 6,143,701; 6,010,987;

EP 0,860,495 is directed to a lubricating oil composition for gas engine heat pumps comprising a base oil and 0.5 to 10 wt % of a metal salicylate detergent having a total base number (TBN) of from 100 to 195 mg KOH/g; 0.1 to 10 wt % of at least one aminic antioxidant; 0.1 to 10 wt % at least one phenolic antioxidant and 1 to 10 wt % of a polyalkenylsuccinimide or a boron-containing poly alkenyl-succinimide. In a preferred embodiment the aminic antioxidant is composed of a dialkyl diphenylamine and a phenyl-α-naphthylamine. Base oils have kinematic viscosities at 100° C. of from 3.5 to 20 $mm^2/s$. No limitation is placed on the base oil, which can be mineral oil or synthetic base oil. Mineral base oils can be oils available from lubricating oil refining steps of raw materials for lubricating oils such as solvent refining using phenol, furfural, N-methyl pyrollidone or the like, hydrofining and wax isomerization, light, medium or heavy neutral oil, bright stock and the like. Synthetic base oils include PAO, polybutenes, alkyl benzene, polyol esters, polyglycol esters, dibasic acid esters and the like. In Example 1, a hydrorefined oil was combined with calcium salicylate, phenyl-α-naphthylamine and dialkyl diphenylamine, a hindered phenol mixture, polyalkenylsuccinimide, ZDDP, moly DTC, ethylene-propylene copolymer, polymethacrylate, alkenyl succinic acid, benzotriazole and dimethyl polysiloxane. In subsequent examples the ingredients were either varied or selectively omitted. In all instances the base oil was a hydrorefined oil.

U.S. 2006/0014653 is directed to a low ash, high TBN engine oil comprising a base oil, a detergent package selected from one or more phenates, salicylates and sulfonates each independently having a TBN of from 30 to 350 mg KOH/g and at least 3.5 wt % of one or more antioxidants selected from aminic and phenolic antioxidants. Aminic antioxidants include alkylated diphenylamine, phenyl-α-naphthylamine, phenyl-β-naphthylamines and alkylated α-naphthylamine. Many typical amines of each type are recited in a general disclosure. Phenolic antioxidants are also broadly described. Base oils can be conventional known mineral oils and synthetic. Base oils can be naphthenic base oils, PAO, dibasic acid esters, polyol esters, dewaxed waxy raffinate. Preferred base oils are mineral or synthetic oils which contain more than 80 wt %, preferably more than 90 wt % saturates, less than 1.0 wt %, preferably less than 0.1 wt % sulfur and have viscosity indexes of more than 80, preferably more than 120, and kinematic viscosities @100° C. ranging from 2 to 80 $mm^2/s$.

The Examples employ a mixture of Group III base oils identified as XHVI-5.2 and XHVI-8.2 formulated with the phenolic antioxidant (($C_7$-$C_9$ branched alkyl esters of 3,5-bis (1,1-dimethyl-ethyl)-4-hydroxy benzene propanoic acid) Irganox L-135) and, in one instance the phenolic antioxidant used in combination with Irganox L-57 which is an alkylated diphenylamine.

U.S. 2005/0288194 teaches the preparation of an oligomeric phenolic detergent. Lubricating oils can be formulated comprising any mineral and/or synthetic base oil in combination with the oligomeric phenolic detergent. Base oils include oils derived from natural sources, mineral oil, synthetic oils such as PAO, alkyl benzenes, synthetic esters, Fischer-Tropsch hydrocarbons etc. Other additives can be present including dispersants, phenolic antioxidants, aminic antioxidants such as diphenylamines, alkylated diphenylamine, phenyl α-naphthylamine, alkylated α-naphthylamine, metal dithiocarbamates, anti-rust agents, demulsifiers, extreme pressure agents, friction modifiers, viscosity index improvers, pour point depressants, foam inhibitors, metallic detergents, etc.

In the Example of a formulated oil no aminic antioxidants were employed.

U.S. 2005/0209110 is directed to a lubricating oil containing sulfonates and phenates, a base oil of lubricating viscosity. Base oils include natural and/or synthetic oils, i.e., mineral oils, vegetable oils, petroleum oils, coal or shale oils, polymerized olefins, alkyl benzenes, esters of phosphorus-containing acids, Fischer-Tropsch derived oils, oils from the hydroisomerization of Fischer-Tropsch wax. Antioxidants can be present and include hindered phenols, diphenylamines, molybdenum dithiocarbamates, sulfurized olefins and mixtures thereof. In the Examples a mixture of Exxon™ 600N oil and Exxon™ 150 Bright stock was employed as base oil. None of the Examples appear to utilize any aminic antioxidant of any type.

U.S. 2004/0142827 is directed to a lubricating oil comprising a major amount of at least one Group II, III or IV base oil and a minor amount of 2-(4-hydroxy-3,5-di t-butyl benzyl thiol) acetate hindered phenol antioxidant useful as a natural gas engine oil. Base oils include natural or synthetic oils e.g., animal oils, vegetable oils, petroleum oils, mineral oils and oils derived from coal or shale, oils made by isomerization of synthetic wax or slack wax, hydrocrackate base stock, PAO, alkyl benzenes, poly phenyls, alkylated diphenyl ethers, alkylated diphenyl sulfides, alkylene oxide polymers, esters, polyol esters, phosphate esters, silicon-based oils. Additives include the particularly recited hindered phenol antioxidant, detergent, dispersant, and wear inhibitors. Other additives may also be present including additional antioxidants such as phenolic antioxidants and diphenylamine-type antioxidants which include alkylated diphenylamine, phenyl-α-naphthylamine and alkylated-α-naphthylamine. In the Examples Group I and Group II base stocks were utilized.

U.S. Pat. No. 5,726,133 is directed to a natural gas engine oil comprising an oil of lubricating viscosity which can be any natural or synthetic oil or mixture thereof including base stocks obtained by the isomerization of synthetic wax or slack wax, a detergent package and other additives including dispersants, antioxidants, antiwear agents, metal deactivators, antifoamants, pour point depressants and viscosity index improver, antioxidants may be phenolic or aminic or mixtures thereof. See also US 2005/0153851; U.S. Pat. Nos. 6,140,282; 6,191,081; 6,140,281.

U.S. Pat. No. 6,080,301 is directed to a premium synthetic lubricant base stock having at least 95% non-cyclic isoparaffins. The base stock is made by hydroisomerizing a Fischer-Tropsch wax. The base stock can be formulated into a lubricating oil by adding an effective amount of one or more performance additives including detergents, dispersants, antioxidants, antiwear additives, pour point dispersants, viscosity index improvers, friction modifiers, demulsifiers, antifoamants, corrosion inhibitors, seal swell control additives.

DESCRIPTION OF THE INVENTION

The present invention relates to a method for improving the resistance to least one of oxidation or nitration of a natural gas engine oil as evidenced by an increase in the kinematic viscosity at 100° C. of the natural gas engine oil of less than 40%, preferably less than about 30% increase, more preferably less than about 25% increase, still more preferably less than about 20% increase in the B-10 oxidation-nitration test run for 80 hours at 325° F., comprising formulating a gas engine oil comprising a natural gas engine oil viscosity base stock selected from Group II base stock(s), and/or Group III base stock(s), and/or GTL base stock(s) and/or base oil(s) and/or a hydrodewaxed and/or hydroisomerized/catalytic (and/or solvent) dewaxed waxy feed stock base stock(s) and/or base oil(s), a minor additive amount of an antioxidant combination comprising a mixture of at least one phenolic type antioxidant, preferably a hindered phenol antioxidant and at least one aminic type antioxidant selected from the group consisting of phenyl-α-naphthylamine and alkylated phenyl-α-naphthylamine (APNA).

In the present method the base stock can be any one or more American Petroleum Institute (API) Group II and/or Group III base stock and/or gas-to-liquids (GTL) base stock and/or base oil, and/or hydrodewaxed and/or hydroisomerized/catalytic (and/or solvent) dewaxed waxy feedstock base stock and/or base oil, preferably one or more of GTL base stock and/or base oil and/or hydrodewaxed and/or hydroisomerized/catalytic (and/or solvent) dewaxed waxy feed stock base stock and/or base oil, more preferably one or more of GTL base stock and/or base oil. Further, the API Group II base stock and/or API Group III base stock and/or GTL base stock and/or base oil, and/or hydrodewaxed and/or hydroisomerized/catalytic (and/or solvent) dewaxed waxy feed stock base stock and/or base oil, preferably GTL base stock and/or base oil, can be utilized as such or in combination with up to about 30 wt % a poly alpha olefin co-base stock.

While the kinematic viscosities as measured by ASTM method D445 at 100° C. of the individual base stock or base oil can range from about 2 to 30 $mm^2/s$, preferably from about 3 to 25 $mm^2/s$, when such stocks are employed as the sole base stock in the formulation or as a base oil mixture, the kinematic viscosity of any such sole base stock or base oil of the formulation is in the range of from about 9 to 16 $mm^2/s$, preferably about 9 to 13 $mm^2/s$. Thus, for example a base stock having a KV at 100° C. of e.g. 4 $mm^2/s$ would not be used as such, but could be mixed with one or more additional base stock(s) and/or base oil(s) of different KV, including high KV, to yield a base oil having a KV @100° in the recited range of about 9 to 16 $mm^2/s$.

API Group II base stocks generally have a viscosity index of between about 80 to less than about 120 and contain less than or equal to about 0.03 wt % sulfur and greater than or equal to about 90 wt % saturates. API Group III base stocks generally have a viscosity index equal to or greater than about 120 and contain less than or equal to about 0.03 wt % sulfur and greater than about 90 wt % saturates.

GTL base stock(s) and/or base oil(s) and/or hydrodewaxed and/or hydroisomerized/catalytic (and/or solvent) dewaxed waxy feed stock base stock(s) and/or base oil(s) include one or more of base stock(s) and/or base oil(s) derived from one or more Gas-to-Liquids (GTL) materials, as well as hydrodewaxed, or hydroisomerized/conventional cat (or solvent) dewaxed base stock(s) and/or base oils derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks and/or base oils.

As used herein, the following terms have the indicated meanings:

a) "wax": hydrocarbonaceous material having a high pour point, typically existing as a solid at room temperature, i.e., at a temperature in the range from about 15° C. to 25° C., and consisting predominantly of paraffinic materials;
b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;
c) "hydroprocessing": a refining process in which a feedstock is heated with hydrogen at high temperature and under pressure, commonly in the presence of a catalyst, to remove and/or convert less desirable components and to produce an improved product;
d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;
e) "catalytic dewaxing": a conventional catalytic process in which normal paraffins (wax) and/or waxy hydrocarbons, e.g., slightly branched iso-paraffins, are converted by cracking/fragmentation into lower molecular weight species to insure that the final oil product (base stock or base oil) has the desired product pour point;
f) "solvent dewaxing": a process whereby wax is physically removed from oil by use of chilled solvent or an autorefrigerative solvent to solidify the wax which can then be removed from the oil;
g) "hydroisomerization" (or isomerization): a catalytic process in which normal paraffins (wax) and/or slightly branched iso-paraffins are converted by rearrangement/isomerization into branched or more branched iso-paraffins (the isomerate from such a process possibly requiring a subsequent additional wax removal step to ensure that the final oil product (base stock or base oil) has the desired product pour point);

h) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

i) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched iso-paraffins into more heavily branched iso-paraffins, the resulting product not requiring a separate conventional catalytic or solvent dewaxing step to meet the desired product pour point;

j) the terms "hydroisomerate", "isomerate", "catalytic dewaxate", and "hydrodewaxate" refer to the products produced by the respective processes, unless otherwise specifically indicated;

k) "base stock" is a single oil secured from a single feed stock source and subjected to a single processing scheme and meeting a particular specification;

l) "base oil" comprises one or more base stocks.

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term "(and/or solvent)", is included in the recitation, the process described involves hydroisomerization followed by either or both of catalytic dewaxing or solvent dewaxing which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range separated/fractionated from synthesized GTL materials such as for example, by distillation and subsequently subjected to a final wax processing step which is either or both of the well-known catalytic dewaxing process, or solvent dewaxing process, to produce lube oils of reduced/low pour point; synthesized wax isomerates, comprising, for example, hydrodewaxed, or hydroisomerized/cat (and/or solvent) dewaxed synthesized waxy hydrocarbons; hydrodewaxed, or hydroisomerized/cat (and/or solvent) dewaxed Fischer-Tropsch (F-T) material (i.e., hydrocarbons, waxy hydrocarbons, waxes and possible analogous oxygenates); preferably hydrodewaxed, or hydroisomerized/cat (and/or solvent) dewaxed F-T hydrocarbons, or hydrodewaxed or hydroisomerized/cat (and/or solvent) dewaxed, F-T waxes, hydrodewaxed, or hydroisomerized/cat (and/or solvent) dewaxed synthesized waxes, or mixtures thereof.

GTL base stock(s) and/or base oil(s) derived from GTL materials, especially, hydrodewaxed, or hydroisomerized/cat (and/or solvent) dewaxed F-T material derived base stock(s) and/or base oil(s), and other hydrodewaxed, or hydroisomerized/cat (and/or solvent) dewaxed wax derived base stock(s) and/or base oil(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the hydrodewaxing or hydroisomerization catalytic (and/or solvent) dewaxing of F-T wax, which has a kinematic viscosity of about 4 $mm^2/s$ at 100° C. and a viscosity index of about 130 or greater. Preferably the wax treatment process is hydrodewaxing carried out in a process using a single hydrodewaxing catalyst. Reference herein to Kinematic viscosity refers to a measurement made by ASTM method D445.

GTL base stock(s) and/or base oil(s) derived from GTL materials, especially hydrodewaxed, or hydroisomerized/cat (and/or solvent) dewaxed F-T material derived base stock(s) and/or base oil(s), and other hydrodewaxed, or hydroisomerized/cat (and/or solvent) dewaxed wax-derived base stock(s) and/or base oil(s), which can be used as base stock and/or base oil components of this invention are further characterized typically as having pour points of about −5° C. lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step employing either or both catalytic dewaxing or solvent dewaxing may be practiced to achieve the desired pour point. In the present invention, however, the GTL or other hydrodewaxed, or hydroisomerized/cat (and/or solvent) dewaxed wax-derived base stock(s) and/or base oil(s) used are those having pour points of about −30° C. or higher, preferably about −25° C. or higher, more preferably about −20° C. or higher. References herein to pour point refer to measurement made by ASTM D97 and similar automated versions.

The GTL base stock(s) and/or base oil(s) derived from GTL materials, especially hydrodewaxed or hydroisomerized/cat (and/or solvent) dewaxed F-T material derived base stock(s) and/or base oil(s), and other such wax-derived base stock(s) and/or base oil(s) which can be used in this invention are also characterized typically as having viscosity indices of 80 or greater, preferably 100 or greater, and more preferably 120 or greater. Additionally, in certain particular instances, the viscosity index of these base stocks and/or base oil(s) may be preferably 130 or greater, more preferably 135 or greater, and even more preferably 140 or greater. For example, GTL base stock(s) and/or base oil(s) that derive from GTL materials preferably F-T materials especially F-T wax generally have a viscosity index of 130 or greater. References herein to viscosity index refer to ASTM method D2270.

In addition, the GTL base stock(s) and/or base oil(s) are typically highly paraffinic (>90% saturates), and may contain mixtures of monocycloparaffins and multicyclo-paraffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained by the hydroisomerization/isodewaxing of F-T material, especially F-T wax, is essentially nil.

In a preferred embodiment, the GTL base stock(s) and/or base oil(s) comprises paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) and/or base oil(s), hydrodewaxed or hydroisomerized/cat (and/or solvent) dewaxed F-T material derived base stock(s), and wax-derived hydrodewaxed, or hydroisomerized/cat (and/or solvent) dewaxed base stock(s), such as wax isomerates or hydrodewaxates, are recited in U.S. Pat. Nos. 6,080,301; 6,090,989, and 6,165,949 for example.

Base stock(s) and/or base oil(s) derived from waxy feeds, which are also suitable for use in this invention, are paraffinic fluids of lubricating viscosity derived from hydrodewaxed, or hydroisomerized/cat (and/or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hydrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as F-T waxy oil or petroleum oils by solvent or auto-refrigerative dewaxing. Solvent dewaxing employs chilled solvent such as methyl ethyl ketone (MEK), methyl isobutyl ketone (MIBK), mixtures of MEK/MIBK, mixtures of MEK and toluene, while auto-refrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock and/or base oil and/or wax isomerate base stock and/or base oil as used herein and in the claims is to be understood as embracing individual fractions of GTL base stock and/or base oil and/or of wax-derived hydrodewaxed or hydroisomerized/cat (and/or solvent) dewaxed base stock and/or base oil as recovered in the production process, mixtures of two or more GTL base stock and/or base oil fractions and/or wax-derived hydrodewaxed, or hydroisomerized/cat (and/or solvent) dewaxed base stocks/base oil fractions, as well as mixtures of one or two or more low viscosity GTL base stock and/or base oil fraction(s) and/or wax-derived hydrodewaxed, or hydroisomerized/cat (and/or solvent) dewaxed base stock and/or base oil fraction(s) with one, two or more higher viscosity GTL base stock and/or base oil fraction(s) and/or wax-derived hydrodewaxed, or hydroisomerized/cat (and/or solvent) dewaxed base stock and/or base oil fraction(s) to produce a dumbbell blend wherein the blend exhibits a kinematic viscosity within the aforesaid recited range.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.⁻ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydrodewaxing, or hydroisomerizing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), hydrodewaxed, or hydroisomerized/cat (and/or solvent) dewaxed wax-derived base stock(s) and/or base oil(s), have a beneficial kinematic viscosity advantage over conventional API Group II and Group III base stock(s) and/or base oil(s), and so may be very advantageously used with the instant invention. Such GTL base stock(s) and/or base oil(s) can have significantly higher kinematic viscosities, up to about 20-50 $mm^2/s$ at 100° C., whereas by comparison commercial Group II base oils can have kinematic viscosities up to about 15 $mm^2/s$ at 100° C., and commercial Group III base oils can have kinematic viscosities up to about 10 $mm^2/s$ at 100° C. The higher kinematic viscosity range of GTL base stock(s) and/or base oil(s), compared to the more limited kinematic viscosity range of Group II and Group III base stock(s) and/or base oil(s), in combination with the instant invention can provide additional beneficial advantages in formulating lubricant compositions.

In the present invention mixtures of hydrodewaxate, or hydroisomerate/cat (and/or solvent) dewaxate base stock(s) and/or base oil(s), mixtures of the GTL base stock(s) and/or base oil(s), or mixtures thereof, preferably mixtures of GTL base stock(s) and/or base oil(s), can constitute all or part of the base oil.

The preferred base stock(s) and/or base oil(s) derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)-7000.

The preferred GTL base stock and/or base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2≧4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);
b) divide the total carbon-13 integral area (chart divisions or area counts) by the average carbon number from step a. to obtain the integral area per carbon in the sample;
c) measure the area between 29.9 ppm and 29.6 ppm in the sample; and
d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cyclo-paraffins, which may be present in the oil samples in varying amounts. The cycloparaffins content is measured using Field Ionization Mass Spectroscopy (FIMS).

GTL base stock(s) and/or base oil(s), and hydrodewaxed, or hydroisomerized/cat (and/or solvent) dewaxed wax base stock(s) and/or base oil(s), for example, hydroisomerized or hydrodewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stock(s) and/or base oil(s).

For example, low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility depending on the viscosity grade and the starting olefins, with minor amounts of the higher oligomers, having a viscosity range of about 1.5 to 150 $mm^2/s$, preferably about 4 to 100 $mm^2/s$, more preferably about 10 to 40 $mm^2/s$. Blends of PAOs with different viscosities such as 6 $mm^2/s$ and 40 $mm^2/s$ or 6 $mm^2/s$ and 150 $mm^2/s$ can be used.

The PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimmers of the $C_{14}$ to $C_{18}$ olefins are described in U.S. Pat. No. 4,218,330. PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The oxidation and nitration resistance of the natural gas engine oil formulation employing the above recited base stock(s) and/or base oil(s) is enhanced by the use of a combination of antioxidants consisting of one or more phenol antioxidants, preferably hindered phenolic antioxidant and an aminic antioxidant selected from the group consisting of alkylated phenyl-α-naphthylamine. The degree to which the oxidation and nitration resistance of the formulation is increased is unexpectedly superior to the levels of oxidation and nitration resistance exhibited by gas engine oil formulations which utilize different base stock(s) and/or base oil(s), e.g., Group I base stock(s), or which utilize aminic antioxidants other than the recited alkylated phenyl-α-naphthylamine.

While it is known that a combination of hindered phenolic antioxidant with an aminic antioxidant provides a better antioxidancy performance than either antioxidant alone, it has been unexpectedly found that the combination of a hindered phenolic antioxidant with (alkylated) phenyl-α-naphthylamine antioxidant provides the lubricating oil composition with an improved oxidation and nitration resistance as measured by the viscosity increase of the lubricating oil over the same lubricating oil composition containing an hindered phenolic antioxidant and an alkylamine diphenylamine or alkylated diphenylamine antioxidants.

The antioxidant combination as previously recited comprises a phenolic antioxidant, preferably a hindered phenolic antioxidant and phenyl-α-naphthylamine, preferably alkylated phenyl-α-naphthylamine.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

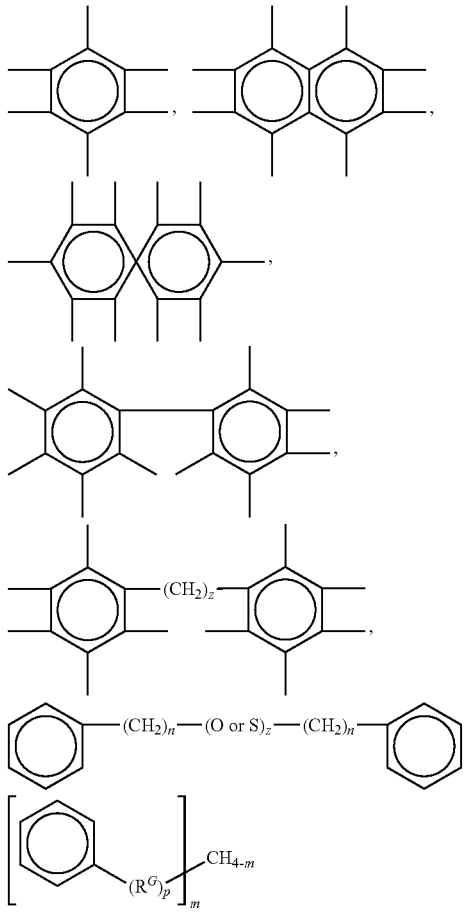

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic antioxidant compounds are the hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol;

2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol.

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic antioxidants which can be used in the present invention.

The phenyl-α-naphthyl amine is described by the following molecular structure

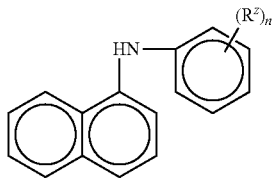

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

The phenolic antioxidant is employed in an amount in the range of about 0.1 to 3 wt %, preferably about 1 to 3 wt %, more preferably about 1.5 to 3 wt % on an active ingredient basis.

The alkylated phenyl-α-naphthylamine is employed in an amount in the range of about 0.05 to 0.5 wt %, preferably about 0.1 to 0.5 wt %, more preferably about 0.2 to 0.5 wt % on an active ingredient basis. The phenolic antioxidant and the alkylated phenyl-α-naphthylamine are employed in a weight ratio in the range of 10:1 to 1:10, preferably 9:1 to 1:1, more preferably 9:1.

The improvement in oxidation and nitration resistance is unexpectedly superior in the gas engine oils comprising the recited base oils, phenolic antioxidant and (alkylated) phenyl-α-naphthylamine as compared to the levels of oxidation and nitration resistance exhibited by gas engine oils comprising different base oils and aminic oxidants other than the phenyl-α-naphthylamine. This unexpectedly superior resistance to oxidation and nitration is evidenced by a much lower increase in the kinematic viscosity at 100° C. of the gas engine oil in the B-10 oxidation-nitration test (80 hours, 325° F.). The improvement in oxidation and nitration resistance achieved by formulating a gas engine oil comprising the recited base stock(s) and/or base oil(s) and the mixture of phenolic antioxidant and (alkylated) phenyl-α-naphthylamine is seen in an increase in the kinematic viscosity at 100° C. of the gas engine oil of less than about 40%, preferably less than about 30%, more preferably less than about 25% still more preferably less than about 20% in the B-10 oxidation-nitration test (80 hours at 325° F.).

Finished lubricants can comprise the recited lubricant base stock or base oil, the phenolic antioxidant and (alkylated) phenyl-α-naphthylamine plus, optionally, at least one additional performance additive.

Examples of typical additives include, but are not limited to, dispersants, detergents, corrosion inhibitors, rust inhibitors, metal deactivators, anti-wear agents, extreme pressure additives, anti-seizure agents, wax modifiers, other viscosity index improvers, other viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant invention in lubricant compositions are not limited by the examples shown herein as illustrations.

Antiwear and EP Additives

Many lubricating oils require the presence of antiwear and/or extreme pressure (EP) additives in order to provide adequate antiwear protection. Increasingly specifications for, e.g., engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.01 to 6 wt %, preferably about 0.01 to 4 wt %, more preferably from about 0.05 to about 1.5 wt %, still more preferably about 0.1 to 1.0 wt % (on an as received basis) of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithio-carbamate trimer complex (R=$C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %, more preferably about 0.05 to 1.5 wt %, still more preferably about 0.1 to 1.0 wt % (on an as received basis) of the total weight of the lubricating oil composition. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAPS formulations.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Supplemental Antioxidants

In addition to the (alkylated) phenyl-α-naphthylamine which is a necessary component of the present invention, one or more other different aminic antioxidants may be used, e.g., other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of such other additional amine antioxidants which may be present include diphenylamines, phenothiazines, imidodibenzyls and diphenyl phenylene diamines. Mixtures of two or more of such other additional aromatic amines may also be present. Polymeric amine antioxidants can also be used.

Another class of antioxidant used in lubricating oil compositions and which may be present in addition to the necessary phenyl-α-naphthylamine is oil-soluble copper compounds. Any oil-soluble suitable copper compound may be blended into the lubricating oil. Examples of suitable copper antioxidants include copper dihydrocarbyl thio- or dithiophosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Such additional antioxidants may be used in an amount of about 0.0 to 5 wt %, preferably about 0 to 2 wt %, more preferably zero to less than 1.5 wt %, most preferably zero (on an as-received basis).

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

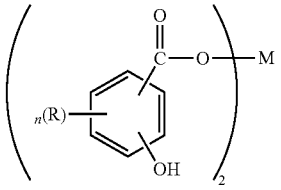

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total amount of neutral and overbased detergent in the lubricating oil composition provides a sulfated ash in the range of from about 0.01 to about 6 wt %, preferably about 0.01 to about 4 wt %, more preferably about 0.1 to about 1.5 wt % (on an as-received basis) of the total weight of the lubricant compositions.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N\text{-}(Z\text{-}NH\text{—})_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %, more preferably about 1 to 6 wt % (on an as-received basis) based on the weight of the total lubricant.

Pour Point Depressants

Conventional pour point depressants (also known as lube oil flow improvers) may also be present. These pour point depressant may be added to lubricating compositions of the present invention to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in amount of about 0.0 to 0.5 wt %, preferably about 0 to 0.3 wt %, more preferably about 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. See, for example, U.S. Pat. Nos. 2,719,125; 2,719,126; and 3,087,932, which are incorporated herein by reference in their entirety. Such additives may be used in an amount of about 0.01 to 5 wt %, preferably about 0.01 to 1.5 wt %, more preferably about 0.01 to 0.2 wt %, still more preferably about 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to about 0.5 wt %, more preferably about 0.001 to about 0.2 wt %, still more preferably about 0.0001 to 0.15 wt % (on an as-received basis) based on the total weight of the lubricating oil composition.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt % on an as received basis.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, organo-Mo-containing compounds, such as dinuclear molybdenum compounds or tri-nuclear molybdenum compounds can be particularly effective as exemplified by Mo-dithiocarbamates (Mo(DTC)), Mo-dithiophosphates (Mo(DTP)), Mo-amines (Mo(Am)), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %, more preferably about 0.01 to 1.5 wt % on an as-received basis. Concentrations of organo-molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil diluent in the formulation. The weight amounts in the table below, however, as well as other amounts mentioned in this text, unless otherwise indicated, are directed to the amount of additive employed on an as-received basis. The wt % indicated below are based on the total weight of the lubricating oil composition.

TABLE A

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-15 | 0.1 to 1.5 |
| Viscosity Improver (active ingredient) | 0.0-8 | 0.0 to 4, more preferably 0.0 to 2 |
| Supplemental Antioxidant | 0.0-5 | 0.0-2 |
| Corrosion Inhibitor | 0.01-5 | 0.01-1.5 |
| Anti-wear Additive | 0.01-6 | 0.01-4 |
| Pour Point Depressant | 0-0.5 | 0-0.3 |
| Anti-foam Agent | <1 | 0.001-0.5 |
| Base Oil | Balance | Balance |

EXAMPLES

B-10 Oxidation Test

The B-10 oxidation test (M334-10) was used to evaluate the resistance of the lubricant to oxidation by air under specified conditions as measured by the change in viscosity. In this method, the sample is placed in a glass oxidation cell together with iron, copper and aluminum catalysts and a weighed lead corrosion specimen. The cell and its content are placed in a bath maintained at test temperature and a measured volume of dried air is bubbled through the sample for the duration of the test (24 hours). The test cell is removed from the bath and the catalyst assembly is removed from the cell. The kinematic viscosity at 100° C. of the oil sample before and after the test is measured by the ASTM D445 test method.

B-10 Oxidation-Nitration Test

The B-10 oxidation-nitration test (1717) was used to evaluate the resistance of the lubricant to oxidation and nitration under specified conditions as measured by the change of the viscosity. In this method, the sample is placed in a glass oxidation cell together with iron, copper and aluminum catalysts and a weighed lead corrosion specimen. The cell and its content are placed in a bath maintained at 325° F. and a measured volume of dried air and nitrous oxides are bubbled through the sample at 10 L/hour for the duration of the test (80 hours). The test cell is removed from the bath and the kinematic viscosity at 100° C. (ASTM D 445) is determined.

Example 1

A series of natural gas engine oil (NGEO) samples were formulated using various base oils. PAO 100 $mm^2/s$ was used with a large excess of GTL-6 $mm^2/s$ base oil to produce a 14 $mm^2/s$ base oil. This series of NGEO samples is presented in Table 1.

TABLE 1

| Components | Oil 1 wt % | Oil 2 wt % | Oil 3 wt % | Oil 4 wt % | Oil 5 wt % | Oil 6 wt % | Oil 7 wt % | Oil 8 wt % | Oil 9 wt % | Oil 10 wt % |
|---|---|---|---|---|---|---|---|---|---|---|
| Components | | | | | | | | | | |
| PAO Base Oil 100 | | | | 28.6 | 21.4 | 21.4 | 21.4 | 21.4 | 21.414 | 21.414 |
| GTL Base Oil GTL-6 | | | | 60.4 | 67.6 | 67.6 | 67.6 | 67.6 | 67.586 | 67.586 |
| Group I (600N) | | | | | | | | | | |
| Group I (150N) | | | | | | | | | | |
| Group II Base Oil | 89.0 | 89.0 | 89.0 | | | | | | | |
| Detergents | 9 | 9 | 9 | 9 | 9 | 9 | 9 | 9 | 9 | 9 |
| Antiwear | | | | | | | | | | |
| Metal Passivators | | | | | | | | | | |
| Dispersants | | | | | | | | | | |
| Antioxidants | | | | | | | | | | |
| Hindered Phenolic[1] | 1.8 | 1.8 | 1.8 | 1.8 | 1.8 | 1.8 | 1.8 | 1.0 | 2.0 | 0 |
| Alkylated[1] Diphenylamine | 0.2 | | | | | | 0.2 | | 0 | |
| Alkylamine[1] diphenylamine | | 0.2 | | 0.2 | | 0.2 | | 1.0 | 0 | |
| Alkylated Phenyl-α-Naphthylamine[1] | | | 0.2 | | 0.2 | | | | 0 | 2.0 |
| Trinuclear Molybdenum Compound, wt % as received | | | | | | | | | | |
| Properties (fresh) | | | | | | | | | | |
| KV @ 40° C., $mm^2/s$ | 127.6 | 127.2 | 124.4 | 109.4 | 79.6 | 79.3 | 79.3 | 79.0 | 79.31 | 81.61 |
| KV @ 100° C., $mm^2/s$ | 13.3 | 13.3 | 13.3 | 16.4 | 12.8 | 12.8 | 12.8 | 12.7 | 12.79 | 13.05 |

| Components | Oil 11 wt % | Oil 12 wt % | Oil 13 wt % | Oil 14 wt % | Oil 15 wt % |
|---|---|---|---|---|---|
| Components | | | | | |
| PAO Base Oil 100 | 21.414 | 20.914 | 20.914 | 20.914 | |
| GTL Base Oil GTL-6 | 67.586 | 67.586 | 67.586 | 67.586 | |
| Group I (600N) | | | | | 68.47 |
| Group I (150N) | | | | | 20.53 |
| Group II Base Oil | | | | | |

TABLE 1-continued

| | | | | | |
|---|---|---|---|---|---|
| Detergents Antiwear Metal Passivators Dispersants Antioxidants | 9 | 9 | 9 | 9 | 9 |
| Hindered Phenolic[1] Alkylated[1] Diphenylamine Alkylamine[1] diphenylamine | 1.75 | 1.75 | 2.0 | 0 | 1.75 |
| Alkylated Phenyl-α-Naphthylamine[1] | 0.25 | 0.25 | 0 | 2.0 | 0.25 |
| Trinuclear Molybdenum Compound, wt % as received | | 0.5 wt % | 0.5 wt % | 0.5 wt % | |
| Properties (fresh) | | | | | |
| KV @ 40° C., $mm^2/s$ | 79.59 | 78.09 | 78.27 | 80.40 | 98.86 |
| KV @ 100° C., $mm^2/s$ | 12.79 | 12.61 | 12.62 | 12.88 | 11.28 |

Hindered Phenol = HP (Irganox L135);
Alkylated diphenylamine = AD (Octyl diphenylamine);
Alkylamine diphenylamine = AADP (branched octyl amine diphenylamine);
Alkylated Phenyl-α-Naphthylamine = APNA (branched octyl phenyl-α-naphthylamine)
[1]All antioxidants were used on an as-received basis, all are 100% active ingredient as received.

The results of the B-10 oxidation tests and B-10 oxidation and nitration tests are reported in Tables 2, 3, 4, 5 and 6.

TABLE 2

| | Antioxidants Wt Ratio | | | | |
|---|---|---|---|---|---|
| | HP/AADP 9:1 Oil 2 | HP/APNA 9:1 Oil 3 | HP/AADP 9:1 Oil 4 | HP/APNA 9:1 Oil 5 | HP/AADP 1:1 Oil 8 |
| B-10 Oxidation Test 24 hrs @ 375° F. | Gr II | Gr II | GTL/PAO | GTL/PAO | GTL/PAO |
| KV @ 100° C., $mm^2/s$ | 14.16 | 13.55 | 18.67 | 14.13 | 15.9 |
| KV @ 100° C. Increase, % | 6.3 | 2.1 | 13.6 | 10.5 | 24.8 |
| B-10 Oxidation Test 24 hrs @ 400° F. | | | | | |
| KV @ 100° C., $mm^2/s$ | 24.64 | 18.25 | 28.2 | — | 24.34 |
| KV @ 100° C. Increase, % | 85.0 | 37.5 | 71.6 | — | 91.1 |

TABLE 3

| | Antioxidants Wt Ratio | | | |
|---|---|---|---|---|
| | HP/AD 9:1 | HP/AADP 9:1 | HP/APNA 9:1 | HP/APNA 7:1 |
| 1717 Test | Oil 1 | Oil 2 | Oil 3 | Oil 15 |
| B-10 Oxidation-Nitration test 80 hrs @ 325° F. | Gr II | Gr II | Gr II | Gr I |
| KV @ 100° C., $mm^2/s$ | 73.33 | 23.68 | 14.07 | 2570 |
| KV @ 100° C. Increase, % | 451 | 78 | 6 | 22684 |

TABLE 4

| | Antioxidants Wt Ratio | | | |
|---|---|---|---|---|
| | HP/AD 9:1 | HP/AADP 9:1 | HP/APNA 9:1 | HP/APNA 7:1 |
| 1717 Test | Oil 7 | Oil 6 | Oil 5 | Oil 11 |
| B-10 Oxidation-Nitration Test 80 hrs @ 325° F. | GTL/PAO | GTL/PAO | GTL/PAO | GTL/PAO |
| KV @ 100° C., $mm^2/s$ | 51.67 | 19.29 | 14.71 | 14.71 |
| KV @ 100° C. Increase, % | 304 | 51 | 15 | 15 |

| 1717 Test | Oil 9 | Oil 10 |
|---|---|---|
| B-10 Oxidation - Nitration test (80 hrs @ 325° F.) | GTL/PAO 2.0 wt % HP | GTL/PAO 2.0 wt % APNA |
| KV @ 100° C. $mm^2/s$ | 37.1 | 37.64 |
| KV @ 100° C. Increase, % | 190 | 188 |

TABLE 5

| 1717 | Oil 12 | Oil 13 | Oil 14 |
|---|---|---|---|
| B-10 Oxidation - Nitration test (80 rs @ 325° F.) | GTL/PAO HP/APNA 7:1 0.5 wt % Moly Cpd | GTL/PAO 2.0 wt % HP 0.5 wt % Moly Cpd | GTL/PAO 2.0 wt % APNA 0.5 wt % Moly cpd |
| KV @ 100° C. $mm^2/s$ | 20.27 | 22.33 | — |
| KV @ 100° C. Increase, % | 61 | 77 | — |

What is claimed is:

1. A method for improving the resistance to oxidation and nitration of a natural gas engine oil said method comprising formulating a gas engine oil comprising 89 wt % natural gas engine oil viscosity base stock selected from the group consisting of one or more Group II base stocks(s), and a blend of a poly alpha olefin base stock and a GTL base stock and a minor additive amount of an antioxidant consisting of a mixture of at least one phenolic type antioxidant selected from the group consisting of benzenepropanoic acid 3, 5-bis-(1, 1-dimethyl-ethyl)-4-hydroxy-$C_7$-$C_9$ branched alkyl ester in an amount in the range of 1.75 to 1.80 wt % on an active ingredient basis and at least one aminic type antioxidant selected from the group consisting of (alkylated) phenyl-a-naphthylamine in an amount in the range of 0.20 to 0.25 wt % on an active ingredient basis, wherein the resistance to oxidation and nitration of said formulated oil is improved in comparison to the resistance to oxidation and nitration exhibited by a comparative natural gas engine oil containing the same recited base stock(s) and/or base oil(s) as said formulated oil in substantially the same amounts, the same phenolic antioxidant as said formulated oil in substantially the same amount, and substantially the same amount of amine antioxidants other than an (alkylated) phenyl-a.-naphthylamine, and wherein the increase in the kinematic viscosity at 100° C. of the natural gas engine oil is less than 40% in the B-10 oxidation-nitration test run for 80 hours at 325° F.

2. The method of claim 1 wherein the phenolic antioxidant and (alkylated) phenyl-a-naphthylamine are present in a weight ratio in the range of 9:1 to 7:1.

3. The method of claim 1 or 2 wherein the alkyl group of the phenyl-a-naphthylamine is alkylated and the alkyl group is a $C_1$-$C_{14}$, linear alkyl or $C_3$-$C_{14}$ branched alkyl group.

4. The method of claim 3 wherein the alkyl group of the alkylated phenyl-a-naphthylamine is a $C_1$-$C_8$ linear alkyl or $C_1$-$C_8$ branched alkyl group.

5. The method of claim 1 or 2 wherein the base stock has a kinematic viscosity @ 100° C. in the range of from about 9 to 16 $mm^2/s$.

6. The method of claim 1 or 2 wherein the base stock is one or more Group II base stock.

7. The method of claim 1 wherein the base stock is a blend of a poly alpha olefin base stock and a GTL base stock.

8. The method of claim 7 wherein the base stock consists of 67.6 wt % of GTL base oil.

* * * * *